US009046246B1

(12) United States Patent
Titus

(10) Patent No.: US 9,046,246 B1
(45) Date of Patent: Jun. 2, 2015

(54) STAINED GLASS LAMPSHADE AND METHOD OF MAKING STAINED GLASS LAMPSHADE

(71) Applicant: Jeffery E. Titus, Palm Bay, FL (US)

(72) Inventor: Jeffery E. Titus, Palm Bay, FL (US)

( * ) Notice: Subject to any disclaimer, the term of this patent is extended or adjusted under 35 U.S.C. 154(b) by 253 days.

(21) Appl. No.: 13/800,041

(22) Filed: Mar. 13, 2013

(51) Int. Cl.
*B44C 3/12* (2006.01)
*F21V 1/20* (2006.01)
*F21V 1/26* (2006.01)

(52) U.S. Cl.
CPC .... *F21V 1/20* (2013.01); *F21V 1/26* (2013.01)

(58) Field of Classification Search
CPC ..... F16J 15/328; B23K 1/018; Y02E 30/40
USPC ..... 29/527.1, 592, 469, 428
See application file for complete search history.

(56) References Cited

U.S. PATENT DOCUMENTS

| | | | | |
|---|---|---|---|---|
| D16,350 | S | | 10/1885 | Jenkins |
| 922,964 | A | | 5/1909 | Schwickart |
| 928,340 | A | | 7/1909 | Steffin |
| 1,041,938 | A | | 10/1912 | Young |
| 1,463,722 | A | | 7/1923 | O'Boyle |
| D76,987 | S | | 11/1928 | Cricchio |
| 1,769,000 | A | | 7/1930 | Smith |
| 3,872,574 | A | | 3/1975 | Worden |
| 3,925,079 | A | | 12/1975 | Hager |
| 4,009,309 | A | | 2/1977 | Holt |
| 4,452,839 | A | | 6/1984 | Worden |
| 4,483,813 | A | * | 11/1984 | Longo ..... 264/225 |
| 4,557,772 | A | | 12/1985 | Crist |
| 5,866,225 | A | | 2/1999 | Crossley |
| 5,935,670 | A | | 8/1999 | Downs |
| 7,168,268 | B2 | | 1/2007 | Czarnetzki |

* cited by examiner

*Primary Examiner* — Brent O'Hern
(74) *Attorney, Agent, or Firm* — Brian S. Steinberger; Law Offices of Brian S. Steinberger, P.A.

(57) ABSTRACT

Stained glass lampshades and decorative lamps and methods of making and fabricating stained glass lampshades and other ornamental shades and decorative articles for lamps, formed from customized glass tiles, that allow for additional glass tiles to be hung from hooks on fixed glass tiles, and allowing for indicia, such as but not limited to names, birthdays, designs, logos and pictures to be customized on selected glass tiles. Water jet cut glass tiles can be attached to one another into a hemi-spherical shape by a cured and hardened grout between each tile.

13 Claims, 8 Drawing Sheets

STAINED GLASS LAMPSHADE AND METHOD OF MAKING STAINED GLASS LAMPSHADE

FIELD OF INVENTION

This invention relates to lampshades, and in particular to stained glass lampshades and decorative lamp covering articles and methods of making and fabricating stained glass lampshades and other ornamental shades and decorative articles for lamps, formed from customized glass tiles, that allow for additional glass tiles to be hung from hooks on fixed glass tiles, and allowing for indicia to be customized on selected glass tiles.

BACKGROUND AND PRIOR ART

Stained glass lampshades using different colored glass sections have been popular over the years and are often limited to single glass domes and half spheres, and the like, wherein the individual glass pieces and/or decorative pattern are fixed on the surface. See for example, U.S. Patents: U.S. Pat. No. 928,340 to Steffin; U.S. Pat. No. 1,041,938 to Young; U.S. Pat. No. 1,769,000 to Smith; U.S. Pat. No. 3,872,574 to Worden; U.S. Pat. No. 4,009,309 to Holt; U.S. Pat. No. 4,452,839 to Worden; U.S. Pat. No. 4,883,813 to Longo; and U.S. Pat. No. 4,557,772 to Crist, Jr.

A problem with these current types of glass lampshades are that they have fixed glass pieces that can not be changed and altered once the shade has been fabricated.

The prior art does not describe, teach or suggest methods of making and fabricating stained glass lampshades formed from separate pieces of stained glass that allow for loose glass pieces to be hooked thereon.

The prior art does not allow for the fabricator or user to customize individual pieces of glass, such as adding names of family members, and other selected indicia on the individual pieces of glass, and allow for loose pieces of glass to be hung from directly from glass fixed to the lampshades.

A still another problem is that most stained glass projects are cut with the score and break which is done by hand that can result in nonuniform cut pieces.

U.S. Pat. No. 16,350 to Jenkins shows and describes a "Pendant for Lamps", title, that hooks pendants to a rim around a light shade. However, Jenkins requires a separate rim which would not be aesthetically desirable with a stained glass lamp shade, and Jenkins does not allow for attaching separate glass pieces directly to other glass pieces.

U.S. Design Pat. No. 76,987 to Cricchio shows a "table lamp or article of analogous nature", title, showing the lamp shade having the appearance of leaves on a tree. However, the leaves in Cricchio appear to be fixed which would not allow the leaves to removed. Additionally, Cricchio replicates a tree and not a stained glass lampshade.

Thus, the need exists for solutions to the above problems with the prior art.

SUMMARY OF THE INVENTION

A primary objective of the present invention is to provide stained glass lampshades and decorative articles with customized glass tiles, that allow for additional glass tiles to be hung from hooks on fixed glass tiles, and allowing for indicia to be customized on selected glass tiles.

A secondary objective of the present invention is to provide methods of making and fabricating stained glass lampshades and other ornamental shades and decorative articles for lamps, formed from customized glass tiles, that allow for additional glass tiles to be hung from hooks on fixed glass tiles, and allowing for indicia to be customized on selected glass tiles.

A third objective of the present invention is to provide methods of making and fabricating stained glass lampshades and other ornamental shades and decorative articles for lamps, formed from customized glass tiles where individual tiles ("leaves") are cut from glass sheets with water jets to form selected geometrical shapes.

A method of making a stained glass lampshade, an include the steps of cutting glass into individual tiles of glass, forming indicia onto front surfaces of the individual cut tiles, printing tile location positions for on an exterior of a semi-hemispherical form, attaching a removable layer to back surfaces of the individual cut tiles, wrapping the form in a clear plastic sheet, attaching the cut tiles to be positioned over the printed location positions, grouting spaces between each of the attached tiles with a grout, curing the grout into a hardened grout which interlocks the cut tiles with one another over the semi-hemispherical form, removing the form and the removable layer from the interlocked cut tiles, to form a finished lamp shade, attaching hangers to exterior or interior lower edges of the lamp shade, and hanging loose cut tiles to the hangers.

The cutting step can include cutting tiles with a water jet.

The forming step of forming can include heating a decal having indicia on the tiles.

The removable layer attaching step can include applying contact paper with a sticky side as the removable layer.

The step of attaching individual tiles can include gluing tiles to the plastic sheet wrapped about the form.

The method can include the step of attaching a wheel ring to an upper opening in the plastic wrapped form;

The method can include the steps of positioning the lampshade with the wheel ring over an upper end of a stem on a lamp base, and attaching the lampshade to the upper end of the stem with a cap.

A stained glass lampshade can include a semi-hemispherical shape with a plurality of cut glass tiles adhered to the surface with grout between each of the cut glass tiles, hooks attached to portions of the grout adjacent to a perimeter base edge of the lamp shade, and loose cut glass tiles hanging from the hooks along the base of the lamp shade.

The plurality of cut glass tiles can be cut with a water jet.

The plurality of cut glass tiles can include indicia that that has been heated onto exterior surfaces of the cut glass tiles.

The indicia can include names permanently on the exterior surfaces of the cut glass tiles.

The indicia can include birthdates permanently on the exterior surfaces of the cut glass tiles.

The indicia can include pictures permanently on the exterior surfaces of the cut glass tiles.

The finished lamp shade can form a family tree lampshade listing names, birthdates, pictures and the like, of families and friends.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1B:
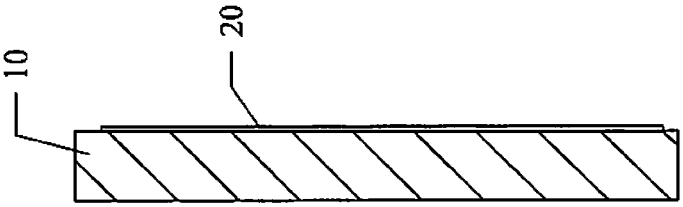
FIG. 1B is a cross-sectional view of the oval tile of FIG. 1A along arrow 1B with the contact paper applied in step 5.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of the components used in the figures will now be described.

10 Oval tile.
20 Contact paper.
30 Text/indicia on tile.
40 Shield tile.
50 Foam form with numbered tile pattern printed on surface.
60 Printed tile pattern number.
70 Printed oval tile pattern.
80 Printed shield tile pattern.
90 Plastic wrap.
100 Metal support wheel ring
102 Bolt
106 Nut
110 Grout.
120 Completed/finished lamp shade.
130 Shield tile with hole for wire hanger.
140 Hole in shield tile.
150 Wire hanger.
160 Glue secures wire hanger to inside grouted surface of lamp shade.
190 Lamp base
192 shade mounting stem with threaded top end
198 threadable cap to hold shade to mounting stem
200 Flow chart showing method of making steps
202 Step 1) Print name and date information, supplied by potential customer, onto "Fusing Photo Paper", with a laser jet printer.
204 Step 2) Cut glass tiles ("leaves") with a water jet.
206 Step 3) Apply name bearing decals to the face of glass "leaves".
208 Step 4) Fire glass "leaves" with decals in kiln, to make names permanent.
210 Step 5) Apply clear contact paper to back of "leaves".
212 Step 6) Draw a "leaf" location diagram on Styrofoam form.
214 Step 7) Wrap the form with plastic wrap.
216 Step 8) Affix 3" brass wheel to the top of the form with a ¼" bolt and nut.
218 Step 9) Attach glass "leaves" to the form using one "Glue Dot" (U.S. Pat. No. 5,935,670) per "leaf".
220 Step 10) Grout spaces between "leaves" with epoxy grout.
222 Step 11) Clean excess grout off outside of "leaves".
224 Step 12) Remove Styrofoam form when grout becomes rigid.
226 Step 13) Peel contact paper off inside of "leaves" and remove any excess grout.
228 Step 14) Glue on wire hooks to inside edge or outside edge portion of lamp shade base edge area to accommodate bottom row of loose hanging tiles ("leaves").
230 Step 15) Install light bulb in lamp base.
232 Step 16) Install shade on base.
234 Step 17) Hang bottom row of "leaves" on hooks.
236 Step 18) Install 3" vented brass vase cap on top of wheel.

Figure 1A:
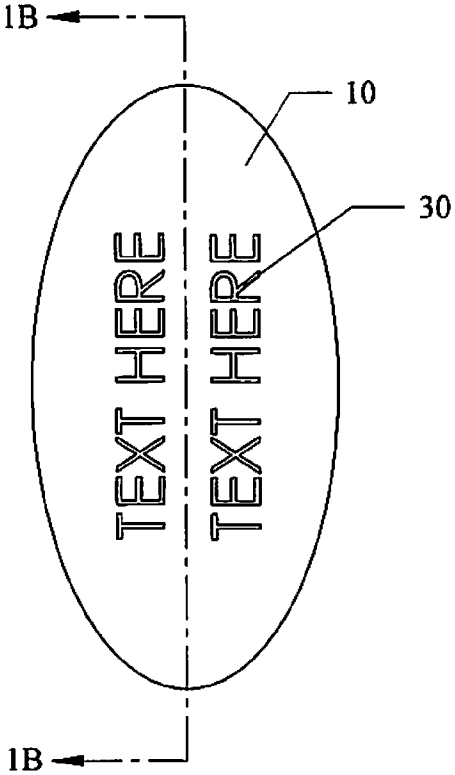
FIG. 1A shows an oval tile with text that can occur from method of making steps 1-5 of the invention.

FIG. 1A shows an oval tile 10 with text 30 that can be made from method of making steps 1-5 of the invention. FIG. 1B is a cross-sectional view of the oval tile 10 of FIG. 1A along arrow 1B showing the contact paper 20 applied in step 5. FIG. 6 is a flowchart showing the method steps 1-18 followed to make a preferred embodiment of the novel stained glass lampshade 180 of FIG. 5.

Referring to FIGS. 1A and 1B, and the flowchart 200 of FIG. 6, steps 1, 2, 3, 4 and 5 will now be described. Step 1 is to print name and date information, supplied by potential customer, onto a photo type paper, such as a "Fusing Photo Paper", with a laser jet printer, 202 FIG. 6.

Step 2 is to cut glass tiles ("leaves") with an automated tool such as but not limited to a water jet, 204 FIG. 6. Glass tiles of different colors can be formed from glass cut with water jets to form tiles ("leaves") 10 of different geometrical and selected shapes, such as but not limited to oval shapes, shield shapes and the like.

Step 3 is to apply name/indicia 30 bearing decals to a face of the tiles ("leaves"). The indicia can include selected designs, logos, and pictures of family and/or friends and the like, 206 FIG. 6. Names can be family names and the like, with or without other information, such as but not limited to date of birth, death, thereon.

Step 4 is to fire (heat) the glass tiles ("leaves") 10 with decals in an oven or kiln, to make the names/indicia permanent on each of the tiles ("leaves") 208 FIG. 6.

Step 5 is to apply clear contact paper 20 to back of each of the tiles ("leaves") 210. The contact paper 20 can have a light adhesive, such as that found on "sticky" notes and the like, so that the contact paper can easily be peeled off and removed later on from the tiles ("leaves") 10.

Figure 2A:
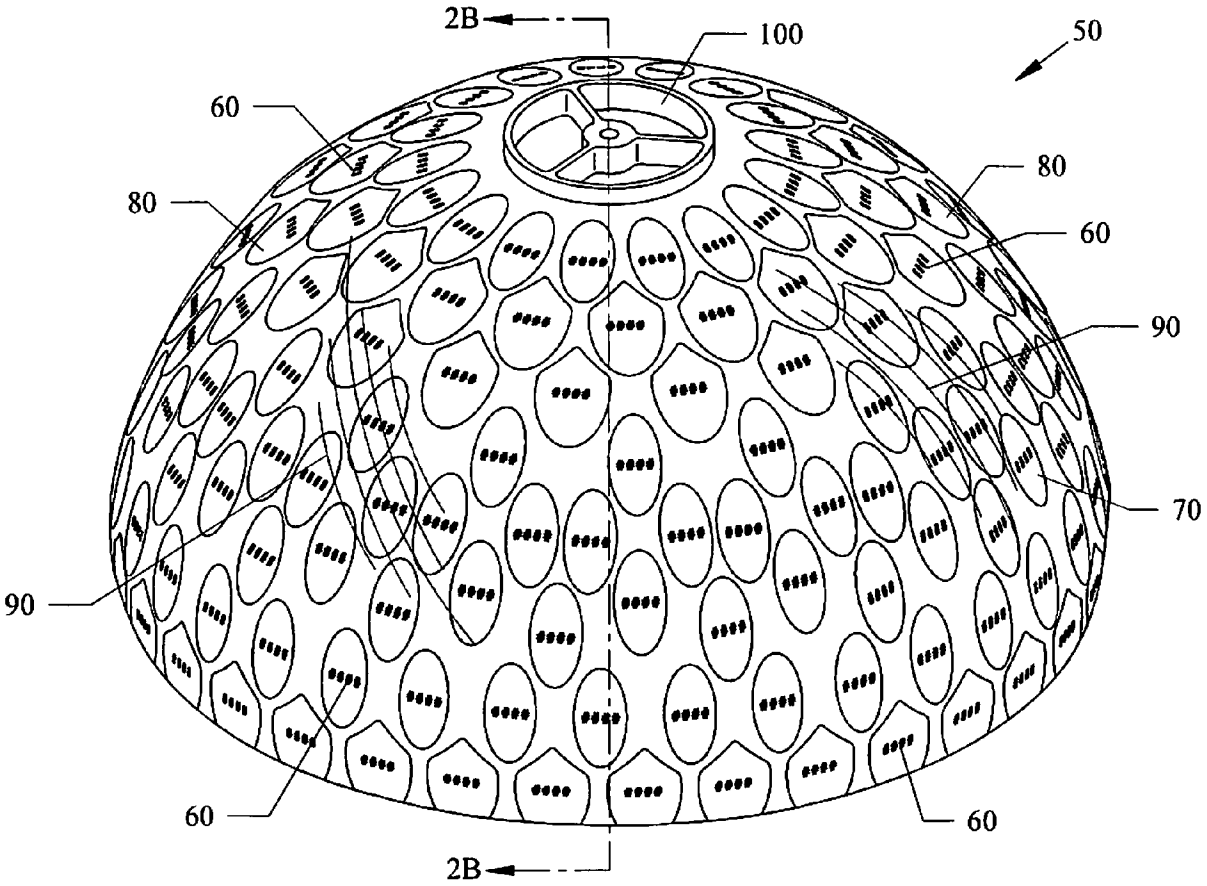
FIG. 2A is a perspective view of a foam hemispherical form with tile locations patterns wrapped in plastic wrap with lamp attachment post wheel ring affixed from method of making steps 6-8.
Figure 2B:
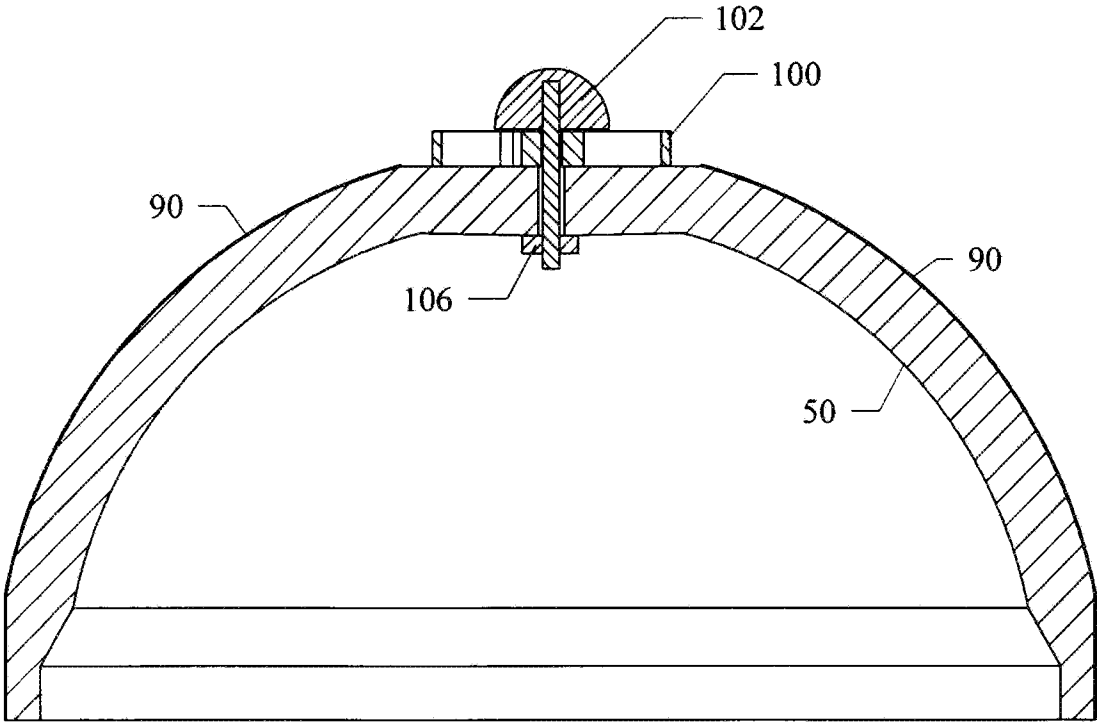
FIG. 2B is a cross-sectional view of the hemispherical form of FIG. 2A.

FIG. 2A is a perspective view of a foam hemispherical form 50 with tile location patterns wrapped in plastic wrap (90 FIG. 2B) with lamp attachment wheel ring 100 affixed from method of making steps 6-8. FIG. 2B is a cross-sectional view of the hemispherical form 50 of FIG. 2A.

Referring to FIGS. 2A and 2B, and the flowchart 200 of FIG. 6, steps 6, 7 and 8 will now be described.

Step 6 is to draw a tile ("leaf") location diagram a Styrofoam form 50, such as but not limited by using the "GF16 Worden System" described in U.S. Pat. No. 4,452,839 to Worden, which is incorporated by reference in its entirety 212 FIG. 6. In a preferred embodiment a 16" diameter hemispherical form was used since it was inexpensive and readily available.

Here, individual tile shapes such as an oval tile pattern(s) 70 and shield tile pattern(s) 80 can be pre-located on the form with outlines of these patterns used in order to locate the different cut tiles ("leaves") thereon. Different numbers 60 can be printed inside of these shapes in order to count the number of shapes so that the correct number of tiles ("leaves") can be cut. Although oval and shield printed shapes are shown, the tiles ("leaves") can have any other geometrical shape as desired.

Step 7 is to wrap the form with plastic wrap 90, 214 FIG. 6.

Step 8 is to affix a lamp wheel ring 100 (such as but not limited to a 3" brass Odyssey brand wheel ring) to the top of the form 50 with a bolt 102 (such as but not limited to a ¼" bolt and nut 106. The wheel ring 100 is the support structure of the finished lamp shade (180 FIG. 4) that will pass over or thread onto the top of the stem 192 the lamp base 190, FIGS. 4 and 216 FIG. 6.

Figure 3A:
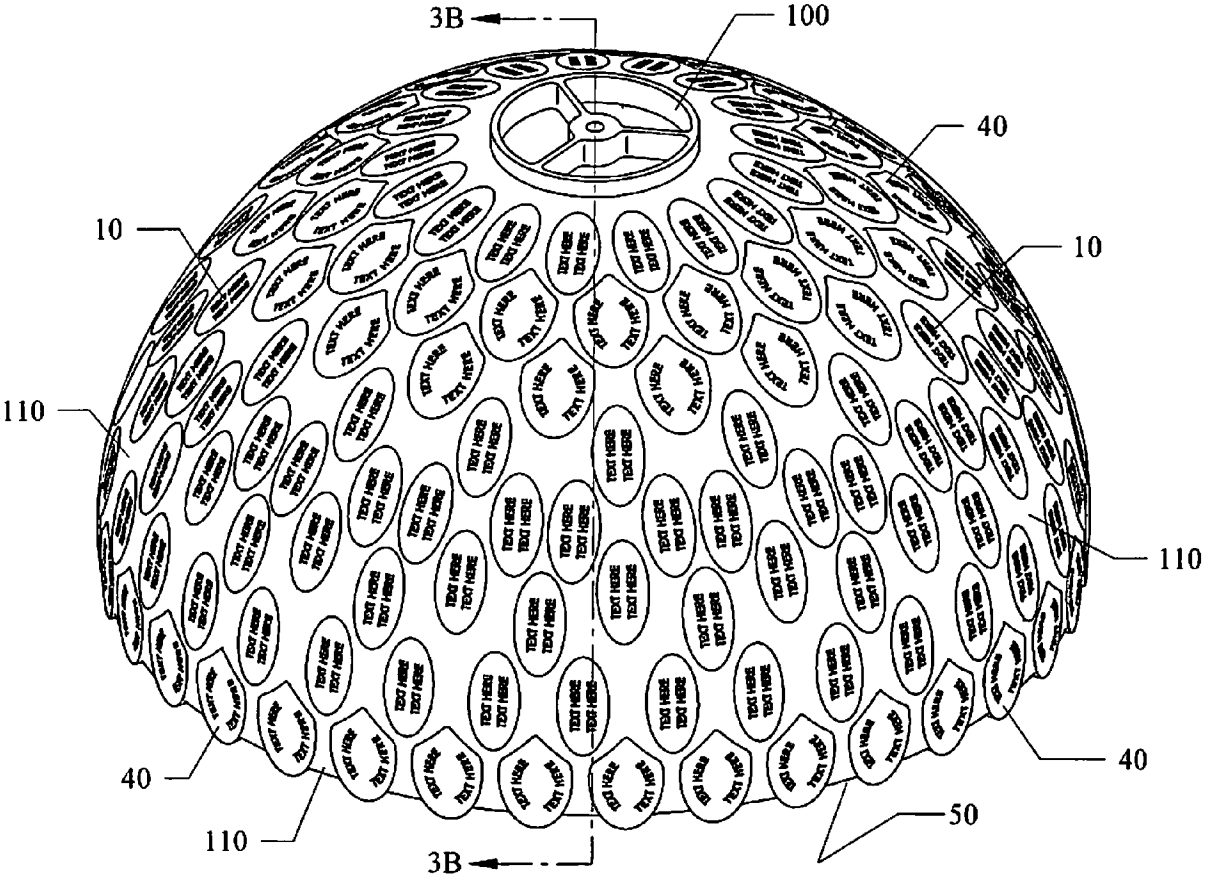
FIG. 3A is a perspective view of the hemispherical form of FIG. 2A with the tiles of FIG. 1A affixed thereon from method of making steps 9-11.

FIG. 3A is a perspective view of the hemispherical form 50 of FIG. 2A with the tiles ("leaves") of FIG. 1A affixed thereon from method of making steps 9-11.

Referring to FIG. 3A, and the flowchart 200 of FIG. 6, steps 9, 10 and 11 will now be described.

Step 9 is to attach glass tiles ("leaves") 10 (that include different shaped tiles, such as ovals 10 and shields 40) to the outer plastic 90 wrapped about the form 50 with an adhesive per each tile ("leaf") 218 FIG. 6. Such an adhesive can include but is not limited to using "Glue Dot" per tile, as described in U.S. Pat. No. 5,935,670 to Downs, which is incorporated by reference in its' entirety.

Step 10 is to grout 110 spaces between each of the tiles ("leaves") 10, 40 with an epoxy grout 110 as referenced in 220 FIG. 6.

Step 11 is to clean excess grout off the outside of each of the tiles ("leaves") 10, 40 as referenced in 222 FIG. 6.

Figure 3B:
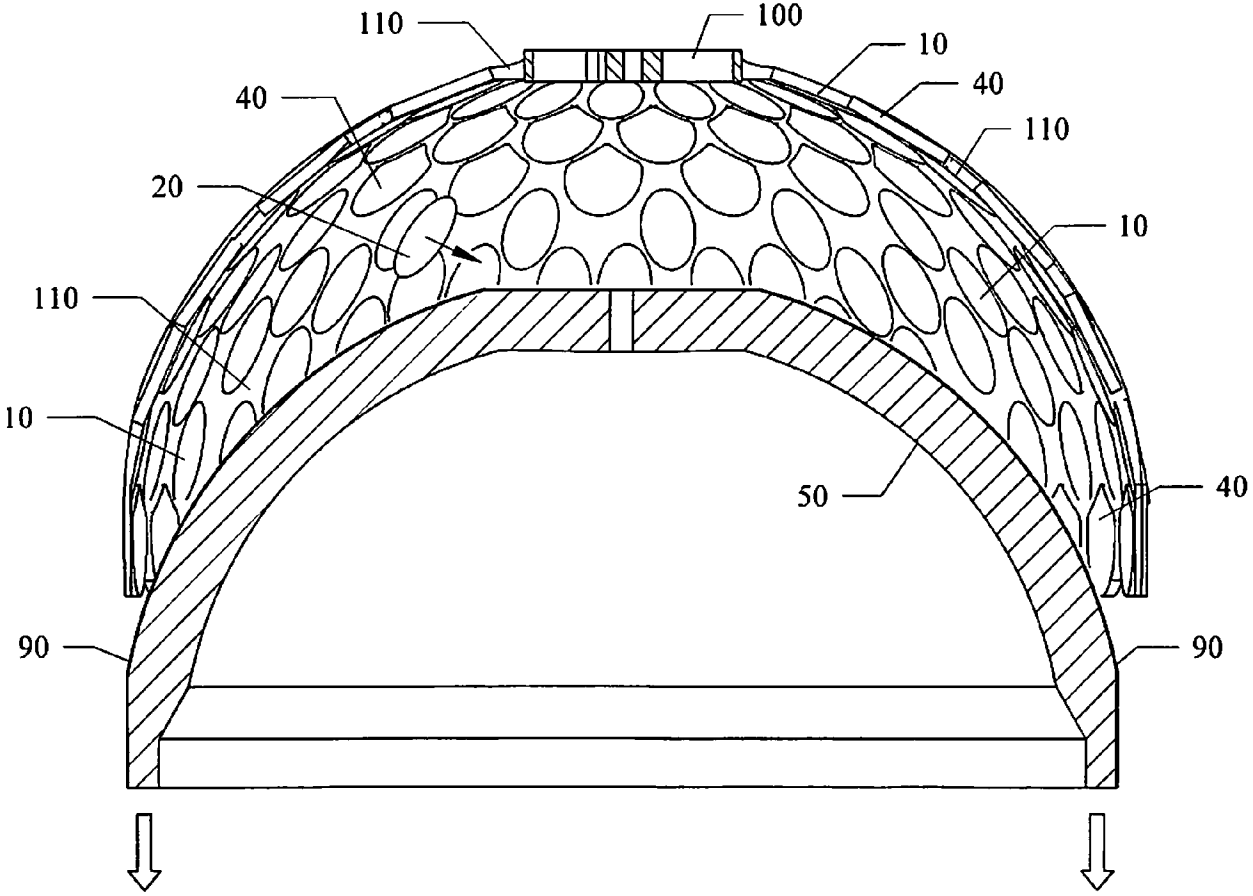
FIG. 3B is a cross-sectional view of FIG. 3A showing the form being backed out and removed, and removal of contact paper from method of making steps 12-13.

FIG. 3B is a cross-sectional view of FIG. 3A showing the form 50 being backed out and removed, and removal of contact paper 90 from method of making steps 12-13.

Referring to FIG. 3B and the flowchart 200 of FIG. 6, steps 12 and 13 will now be described.

Step 12 is to remove the Styrofoam form 50 when grout 110 has cured and becomes rigid, by backing the form 50 from the hemispherical shape formed from the tiles ("leaves") and cured grout 110, as referenced in 224 FIG. 6. The bolt 102 and nut 106 is first taken off so that the form 50 can be removed.

Step 13 is to peel the removable contact paper 90 off inside surfaces of the grouted tiles ("leaves") and remove any excess grout when backing out the form 50. The paper can be peeled off from the inside surfaces of the hemispherical shape of the grout connected tiles ("leaves").

Figure 4:
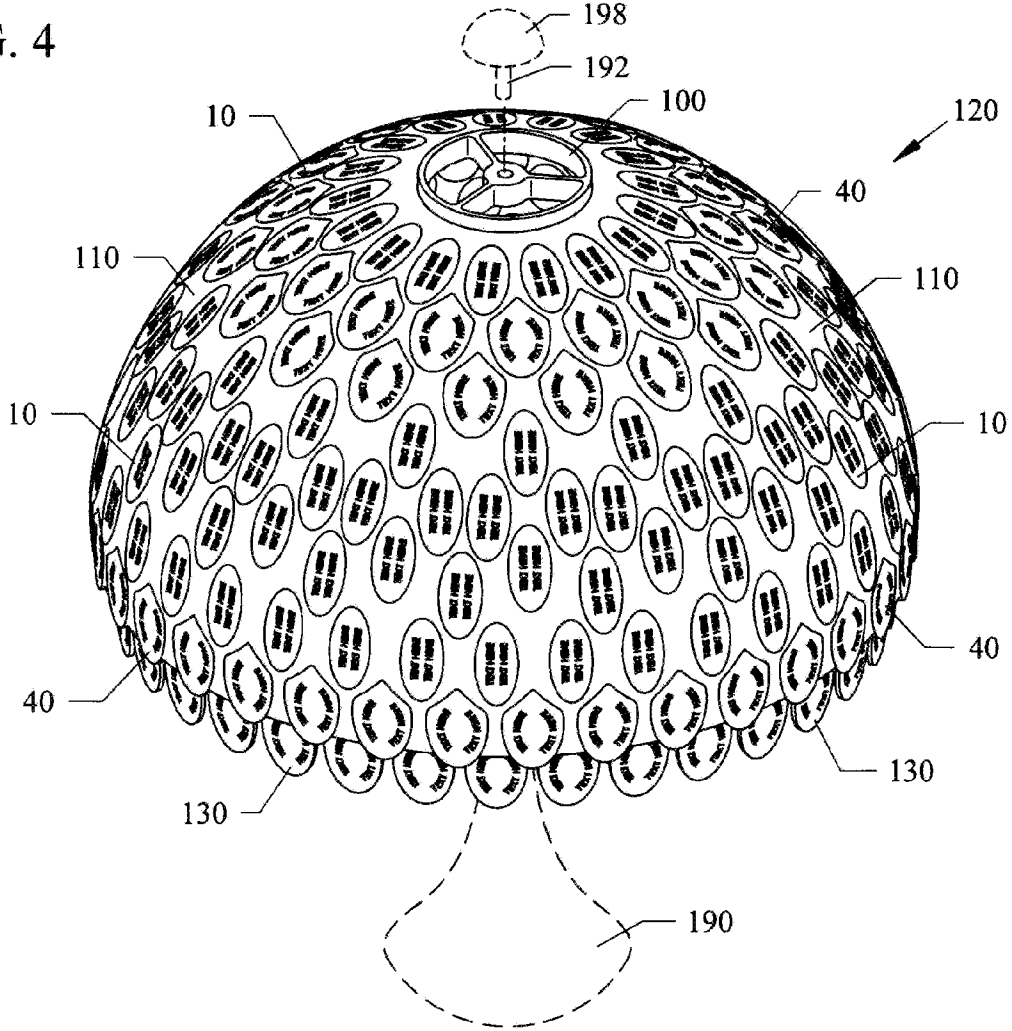
FIG. 4 is a perspective view of the hemispherical form of FIGS. 3A-3B with wire hooks adhered thereon, and additional tiles hanging from the hooks with the lampshade installed on a post of a lamp base of method steps 14-18

FIG. 4 is a perspective view of the hemispherical finished lampshade 120 of FIGS. 3A-3B with wire hooks adhered thereon, and additional tiles 130 hanging from the hooks with the lampshade 120 installed on a post 192 of a lamp base 190 of method of making steps 14-18

Figure 5:
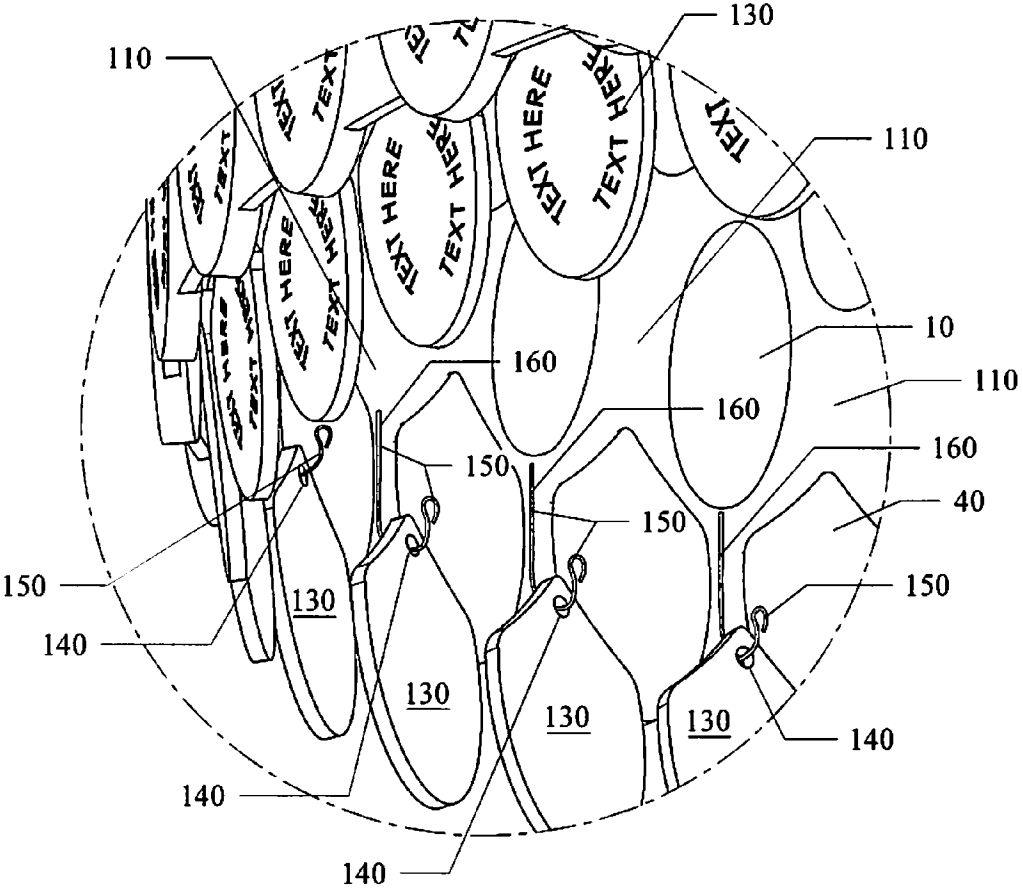
FIG. 5 is an enlarged view of a bottom end of the lampshade of FIG. 4 showing wire hangers glued to grout of shade and shield tiles with holes on the hanging tiles for the hooks.
Figure 6:
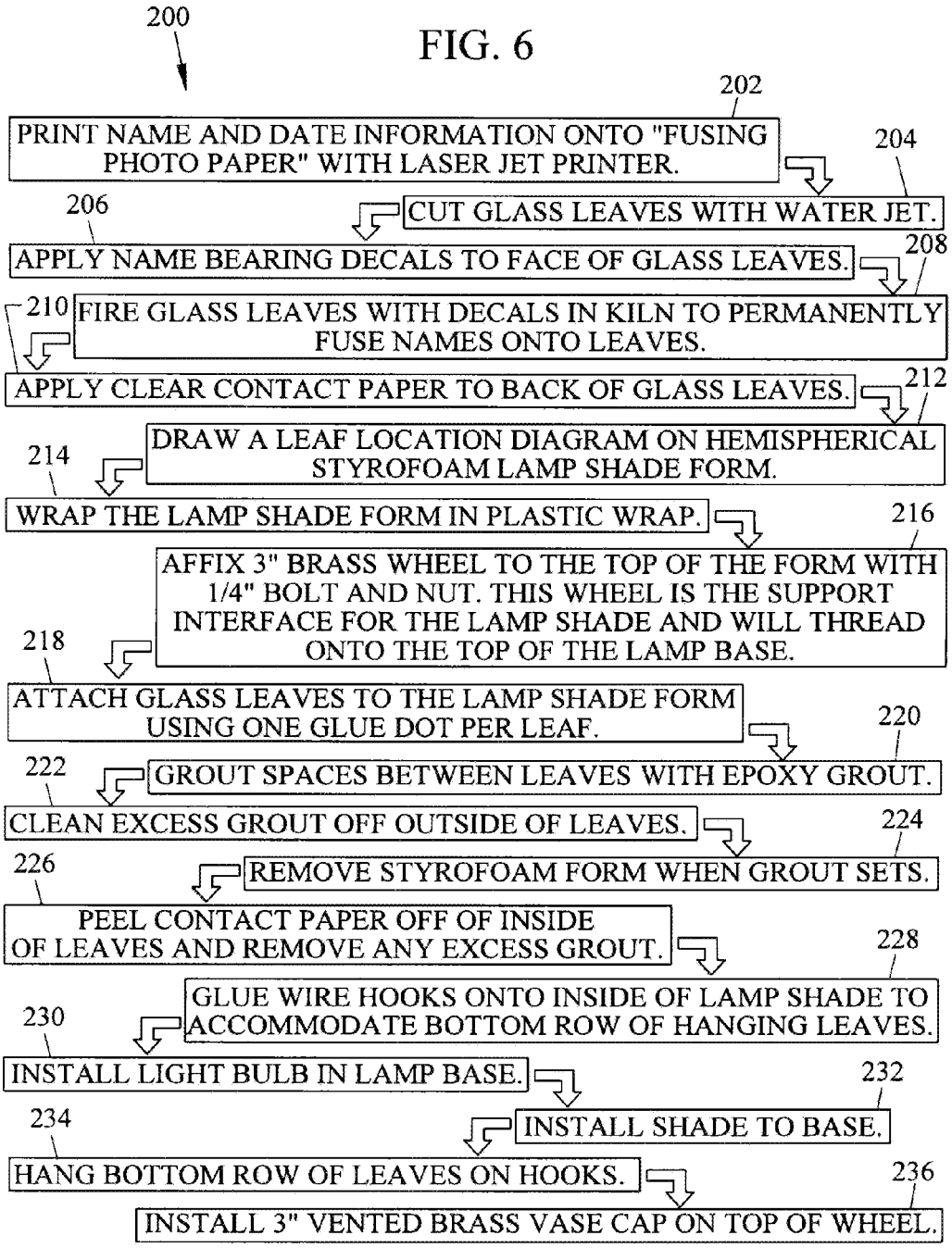
FIG. 6 is a flowchart showing method steps to make an embodiment of the stained glass lampshade of FIGS. 1-5.

FIG. 5 is an enlarged view of a bottom end of the finished lampshade 120 of FIG. 5. showing wire hangers/hooks 150 glued 160 to grout 110 of the shade 120 and shield shaped tiles 130 with holes 140 on the hanging tiles 130 for hanging to the hooks 150

Referring to FIGS. 4 and 5, and 200 FIG. 6, steps 14-18 will now be described.

Step 14 is to glue on wire hooks 150 to inside edge portions of grout or outside edge portions of the grout adjacent to the base of the lamp shade 120 to accommodate bottom a row of loose hanging tiles ("leaves") 130 as referenced in 228 step 14 FIG. 6. Although shield shaped tiles 130 are shown, the invention can use different shaped tiles ("leaves"), such as but not limited to ovals and other selected geometrical shapes and the like.

Step 15 is to install a conventional light bulb (not shown) in socket (not shown) of a lamp base 190, 230 FIG. 6

Step 16 is to install shade on base 190, as referenced in 232 FIG. 6. Installation can be by positioning the center hole of the wheel ring 100 of the finished lamp shade 120 over the top of lamp stem 192, and now or later locking the lampshade 120 in place with a screw on cap 198.

Step 17 is to hang a bottom row of tiles ("leaves") on the hooks 150 along the base of the lamp shade 120, as referenced in 234 FIG. 6.

Step 18 is to install a cap, such as but not limited to a 3" vented brass vase cap 198 on top of wheel ring 100 and screw it onto threaded top of stem 192 of the lamp base 190.

With the completed/finished lampshade 120 installed on a lamp base 190, the lampshade can display different names (and other information, such as but not limited to birthdays, and pictures) of family members on each of the tiles ("leaves"), so that the finished lampshade forms a family tree.

Although the preferred embodiment shows loose hanging tiles 130 on a bottom row of the lampshade 120, the hangers/hooks 150 can be attached to other locations on the lampshade 120 as selected. In addition, the hangers/hooks 150 can be adhered to tiles ("leaves") directly instead of or in addition to being attached to grout 110.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of making a stained glass lampshade, comprising the steps of:

cutting glass into individual tiles of glass forming indicia onto front surfaces of the individual cut tiles;

printing tile location positions on an exterior of a semi-hemispherical form;

attaching a removable layer to back surfaces of the individual cut tiles;

wrapping the form in a clear plastic sheet;

attaching the cut tiles to be positioned over the printed location positions;

grouting spaces between each of the attached tiles with a grout;

curing the grout into a hardened grout which interlocks the cut tiles with one another over the semi-hemispherical form;

removing the form and the removable layer from the interlocked cut tiles, to form a finished lamp shade;

attaching hangers to lower edges of the lamp shade; and hanging loose cut tiles to the hangers.

2. The method of claim 1, wherein the cutting step includes the step of:

cutting tiles with a water jet.

3. The method of claim 1, wherein the step of forming includes the step of:

heating a decal having indicia on the tiles.

4. The method of claim 1, wherein the step of attaching the removable layer includes the step of:

providing contact paper with a sticky side as the removable layer.

5. The method of claim 1, wherein the step of attaching the individual tiles includes the step of:

gluing the tiles to the plastic wrap sheet wrapped about the form.

6. The method of claim 1, further comprising the step of;

attaching a wheel ring to an upper opening in the plastic wrapped form.

7. The method of claim 6, further comprising the step of:

positioning the lampshade with the wheel ring over an upper end of a stem on a lamp base; and attaching the lampshade to the upper end of the stem with a cap.

8. A method of making a decorative lampshade, comprising the steps of:

forming individual glass tiles;

printing tile location positions on an exterior of a shade form;

attaching a removable layer to back surfaces of the individual glass tiles;

wrapping the form in a clear plastic sheet;

attaching the tiles to be positioned over the printed location positions;

interlocking the tiles with one another over the form; and removing the form and the removable layer from the interlocked tiles, to form a lamp shade.

9. The method of claim 8, further comprising the steps of:

attaching hangers to lower edges of the lamp shade; and hanging loose tiles to the hangers.

10. The method of claim 8 wherein the interlocking step includes the step of:

grouting spaces between each of the tiles.

11. The method of claim 8, wherein the forming step includes the step of:

cutting the individual tiles.

12. The method of claim 8, wherein the form includes: a semi-hemispherical form.

13. The method of claim 8, further comprising the step of:

applying indicia onto front surfaces of the tiles.

* * * * *